United States Patent [19]

Fette

[11] Patent Number: 4,872,202

[45] Date of Patent: Oct. 3, 1989

[54] ASCII LPC-10 CONVERSION

[75] Inventor: Bruce Fette, Mesa, Ariz.

[73] Assignee: Motorola, Inc., Schaumburg, Ill.

[21] Appl. No.: 256,248

[22] Filed: Oct. 7, 1988

Related U.S. Application Data

[63] Continuation of Ser. No. 650,592, Sep. 14, 1984, abandoned.

[51] Int. Cl.[4] ..... G10L 5/02

[52] U.S. Cl. ..... 381/52

[58] Field of Search ..... 381/52, 51, 53, 36–40; 364/513.5, 900

[56] References Cited

U.S. PATENT DOCUMENTS

| | | | |
|---|---|---|---|
| 3,704,345 | 11/1972 | Coker et al. | 381/52 |
| 4,392,018 | 7/1983 | Fette | 381/51 |
| 4,398,059 | 8/1983 | Lin et al. | 381/51 |
| 4,472,832 | 9/1984 | Atal et al. | 381/40 |
| 4,489,396 | 12/1984 | Hashimoto et al. | 364/900 |
| 4,685,135 | 8/1987 | Lin et al. | 381/52 |
| 4,689,817 | 8/1987 | Kroon | 381/52 |
| 4,692,941 | 9/1987 | Jacks et al. | 381/52 |

OTHER PUBLICATIONS

Smith, "$2000 Test-into-Voice Unit Gives Utterance to Input Almost Immediately", 4/21/81, Electronics, vol. 54, No. 7, pp. 84–86.

Lin, "Text-to-Speech Using LPC Allophone Stringing", May 1981, IEEE Transactions on Consumer Electronics, vol. CE-27, pp. 144–152.

Tremain, "The Government Standard Linear Predictive Coding Algorithm: LPC-10", 4/82, Speech Technology.

Karjalainen, "Aids for the Handicapped Based on Synte 2 Speech Synthesizer", ICASSP 80, 9–11, Apr. 1980, pp. 851–854.

Bernstein et al., "Unlimited Text-to-Speech System: Description and Evaluation of a Microprocessor Based Device", ICASSP 80, pp. 576–579.

Elovitz et al., "Automatic Translation of English Text to Phonetics by Means of Letter to Sound Rules", Navy Research Laboratory Report 7948, 1/21/76.

Groner, "The Telephone-The Ultimate Terminal, Telephony", 6/4/84.

Ciarcia, "Build the Microvox Text-to-Speech Synthesizer", Parts 1–2, BYTE, 10/82–11/82.

*Primary Examiner*—Gary V. Harkcom
*Assistant Examiner*—John A. Merecki
*Attorney, Agent, or Firm*—Frank J. Bogacz

[57] ABSTRACT

A conversion system which checks a word for exceptions; converts the word to phonemes utilizing sentence structure and word structure; and finally, converts the phonemes to LPC parameters. When an exception is found in the first stage the correct phonemes may be provided or an alternate spelling or set of rules may be used to provide the correct phonemes. The LPC parameters are then smoothed, to produce a continuous speech pattern, and then transmitted. This results in the conversion of a computer network signal to a voice network signal.

3 Claims, 2 Drawing Sheets

ASCII LPC-10 CONVERSION

This application is a continuation of prior application Ser. No. 650,592 filed Sept. 14, 1984 now abandoned.

BACKGROUND OF THE INVENTION

1. Field of the Invention

This invention relates, in general, to conversion of a computer network signal and, more particularly, to conversion of a computer network signal to a voice network signal.

2. Background of the Art

Presently there is no technique by which a narrow band voice communication network can access data directly from a computer network. The present invention provides such a technique.

SUMMARY OF THE INVENTION

Accordingly, it is an object of the present invention to provide an ASCII to LPC-10 conversion apparatus and method for linking computer networks with voice networks operating under the LPC-10 (linear predictive coding) standard.

Another object of the present invention is to provide an ASCII to LPC-10 conversion method and apparatus of converting an ASCII code to a 2400 BPS LPC-10 code.

Still another object of the present invention is to provide an ASCII to LPC-10 conversion method and apparatus which utilizes the concepts of text to phoneme conversion; and phoneme to LPC conversion.

The above and other objects and advantages of the present invention are provided by an apparatus and method of linking a computer network to a voice network.

A particular embodiment of the present invention comprises an apparatus and method for checking a word for exceptions, then converting the word to phonemes and finally converting the phoneme to LPC parameters for transmission.

DETAILED DESCRIPTION OF THE INVENTION

Figure 1:
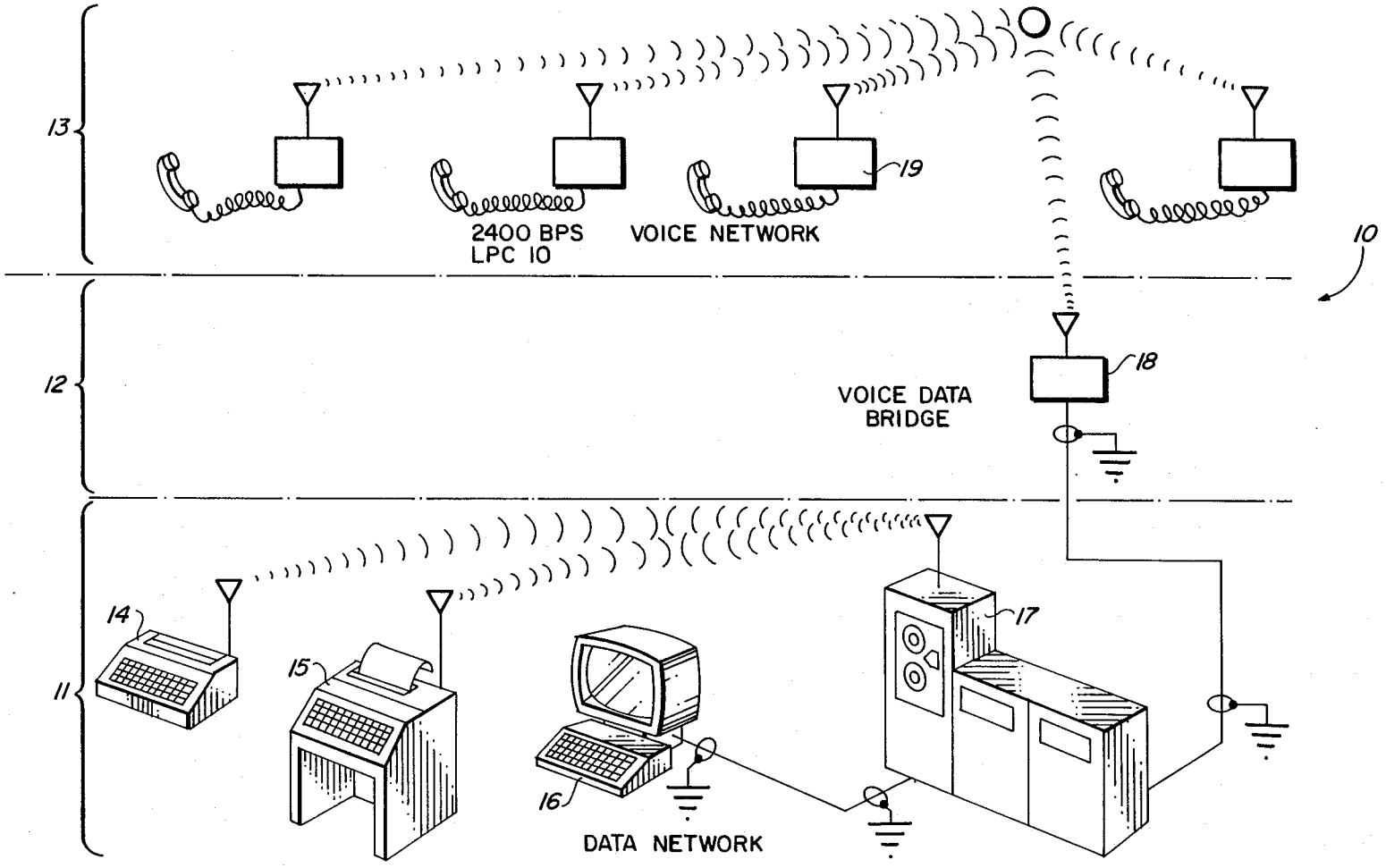
FIG. 1 is a diagrammatic representation of an operating system embodying the present invention.

Referring to the diagram of FIG. 1 a diagrammatic representation of an operating system, generally designated 10, embodying the present invention is illustrated. System 10 has three areas, a data network 11, a voice/-data bridge 12, and a voice network 13. Input to a computer 17 is provided in data network 11 by various devices such as a keyboard 14, a teletype 15, or a computer terminal 16. The connection to computer 17 may be provided by direct line, such as terminal 16, keyboard 14 or by some type of alternate transmission. Computer 17 then provides an ASCII signal to voice/-data bridge 18 which converts the ASCII signal to an LPC-10 signal. This conversion will be discussed in detail hereinafter. The LPC-10 signal is then transmitted to a receiver 19 in voice network 13. System 10 has many applications, one of which is use in military communication networks where individuals operating secure voice radios in the field may need to access data bases in a computer operating on another network.

Figure 2:
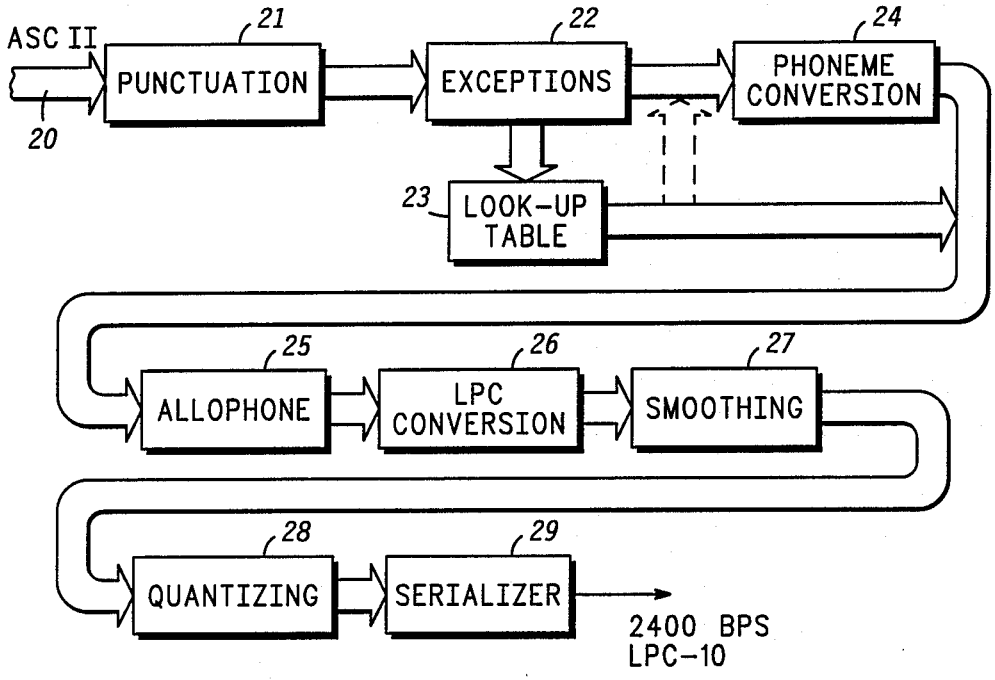
FIG. 2 is a block diagram illustrating a method, followed in converting an ASCII to an LPC-10 signal, utilized by the present invention.

Referring now to FIG. 2, a block diagram illustrating a method followed in converting an ASCII to an LPC-10 signal utilized by the present invention is illustrated. A port 20 is provided for the input of an ASCII code from a computer. This input is first checked for punctuation at block 21 as differing punctuations will effect the emphasis placed on certain words and phonemes (i.e. a member of a set of the smallest units of speech). Next, the signal is transmitted to block 22 where the words are checked for exceptions, words pronounced differently than they are spelled (e.g. papillion is pronounced with a /y/ rather than an /1/ sound). If an exception is found the signal is transmitted to a look-up table, block 23. Block 23 can be designed to provide either the correct phonemes; an alternate spelling; or an alternate set of rules for determining the phonemes (as in a different language). It should be noted that should block 23 provide an alternate spelling, rather than the phonemes for exception type words, the output of block 23 would be transmitted to block 24 as illustrated by the dashed line. If no exception exists the signal is then transmitted to a block 24 where the letters are converted to corresponding phonemes. Phonemes are determined by rules of recognizing sequences of letters as specific phonemes. A catalog of rules for text to phoneme conversion of English are provided in Navy Research Lab (NRL) Report 7948 entitled "Automatic Translation of English Text to Phonetics by Means of Letter to Sound Rules", Jan. 21, 1976. The outputs from blocks 23 and 24 are then transmitted to a block 25 where, if needed, the phonemes are converted to allophones (i.e. one of two or more variations of the same phoneme for word initial, word medial, or word final applications).

Next, the phonemes, or allophones, are transmitted to block 26 where they are converted to LPC-10 parameters. Block 26 provides the number of states, the duration, the voiced/unvoiced (v/uv) signal; the pitch; the amplitude; the reflection coefficients (RC); and smoothing parameters for each phoneme. As this step only provides specific target values for these parameters, the areas between these points must be filled to create continuously flowing speech consistent with human speech. These target values are derived and cataloged by extensive analysis of actual human speech labeled by a phonetician. Block 27 provides this smoothing. Smoothing is equivelent to the smooth motion of the articulators in the vocal tract. Utilizing the smoothing parameter from block 26 the area between pitch targets, for example, for two adjoining phonemes will be filled. The completed smoothed parameters are then transmitted to a quantizer 28 where each of the parameters are quantized. These individual signals are then combined in a serializer 29 to produce a 2400 BPS (Bits Per Second) serial data flow.

It should be noted that data rates of other than 2400 BPS may be utilized. The 2400 BPS signal is utilized in this example as it is the recognized industry standard. A 4800 BPS signal may be generated in this manner, however, the need for such a high quality signal (e.g. being able to distinguish different voices) is lost when a computer is doing the speaking. In addition, the order of the serialization may be changed to represent various standards set by the Department of Defense (DOD), Defense Advanced Research Projects Agency (DARPA)

or other entity. Finally, if other than an ASCII computer character set (such as EBCDIC) is to be utilized this other character set could be converted to ASCII or the various measurements could be set to the new character set.

As an example, the word HELP will be defined through the process. First, the word HELP will be checked to see if it is an exception (for a single word the puncuation checking process will not be discussed). HELP is not an exception and therefore will be transmitted to phoneme converter 24 which will produce the phonemes for the letters /H/ϵ/L/P/, note that /E/ has been changed to its phoneme /ϵ/. This is then transmitted to allophone converter 25 where each phoneme can be given the proper allophone. This is determined, generally, from the surrounding phonemes, stress level, and position of the phoneme within the word. These phonemes and allophones are next transmitted to LPC converter 26 which provides the parameters discussed above. These are illustrated in Table 1 below.

TABLE 1

| STATES | /h/ 1 | /ϵ/ 1 | /1/ 1 | /p/ 3 | | |
|---|---|---|---|---|---|---|
| DURATION | 100 ms | 200 ms | 30 ms | 10 ms | 100 ms | 30 ms |
| VOICED/ UNVOICED | unvoiced | voiced | voiced | look to preceeding letter | unvoiced | unvoiced |
| PITCH | undefined | from global contour | from global contour −3% | same as preceeding phoneme | undefined | undefined |
| AMPLITUDE | −20 dB | 0 dB | −8 dB | dropping from preceeding amp to −40 dB | −40 dB | −40 dB rising to meet amp to right |
| RC's | same as following vowel | target/ϵ/ vowel | target/1/ word final consonant | target/p/ closure | /p/closure | release from/p/ closure |
| SMOOTHING | 25 ms to left & none to right | 25 ms to left & right | 25 ms to left & right | 10 ms to left & none to right | none | none to left & 30 ms to right |

As is shown the /h/ has one state of duration 100 ms. This is an unvoiced signal having an undefined pitch and a −20 dB amplitude. The reflection coefficients for /h/ are generally taken from the following vowel. The /h/ has 25 milliseconds smoothing to the left side and none to the right side. It should be noted that the numbers provided in Table 1 are given by way of example only and are not meant to be exact parameters.

The /ϵ/ has one state of a 200 ms duration. The signal is voiced and has a pitch taken from the global contour (i.e. structure of the entire sentence). The amplitude of the phoneme is 0 dB and the reflection coefficients have a target value taken from the value of /ϵ/. The /ϵ/ is smoothed 25 milliseconds to the left and right.

The /1/ has a single state of 30 ms duration. By pronouncing the word HELP you can hear that the /1/ phoneme has a shorter duration than the other sounds. This is a voiced phoneme and has a pitch taken from the global contour less 3 percent. The amplitude is −8 dB and the reflection coefficients have a target value of /1/. The /1/ is smoothed 25 ms to the left and right. As smoothing time is greater than the duration the target value is never reached.

Finally, the /p/ has three separate states. The first state has a duration of 10 ms. The voiced/unvoiced parameter is derived from the preceeding phoneme as is the pitch. The amplitude drops from the preceeding phoneme (−8 dB) to −40 dB. The reflection coefficients have a target of /p/ closure and there is a 10 ms smoothing to the left and none to the right. The second state has a duration of 100 ms and is unvoiced. The pitch is undefined and the amplitude is −40 dB. The reflection coefficients are set to /p/ closure and there is no smoothing. Last, the third stage has a duration of 30 ms and is unvoiced. The pitch is undefined and the amplitude ranges from −40 dB to the amplitude of the stage to the right. The reflection coefficients are set to a release from /p/ closure. There is no smoothing to the left and 30 ms to the right.

The result of the prior step is that there are now six different sets of unconnected LPC parameters. These parameters are therefore transmitted to an articulating and positioning device where they are smoothed, or connected, utilizing the different parameter values and the smoothing parameter. These smoothed parameters are then quantized and combined in series to provide a 2400 BPS LPC-10 signal.

The smoothing is not performed directly on reflection coefficients sequences. Rather, the smoothing is set to reflect the sequence changes of normal human articulation. To accomplish this the reflection coefficient targets are converted to area ratios of the equivalent human vocal tract. These area ratios are then transformed to human tongue, lip, jaw and nasopharynx shapes. These articulator shapes are then smoothed with physically appropriate time constants, appropriate physical boundaries, and appropriate physical coupling between articulators. The articulator shapes are then sampled at the 22.5 millesecond frame rate appropriate for Federal Standard 1015 LPC-10 2400 BPS vocoders. The articulator shape is then converted back to area ratios and then to reflection coefficients.

Figure 3:
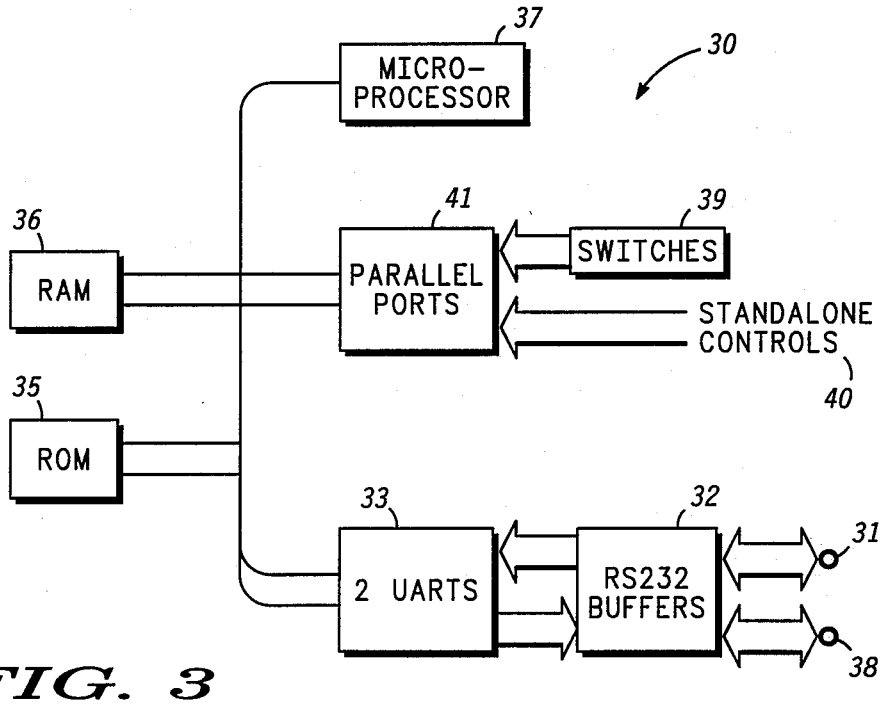
FIG. 3 is a block diagram of the ASCII to LPC-10 bridge of FIG. 2.

Referring now to FIG. 3 a block diagram, generally designated 30, of the ASCII to LPC-10 bridge of FIG. 2, is illustrated. Device 30 illustrates an input port 31 which would be coupled to computer network 11 of FIG. 1. Input port 31 is coupled to an RS232 buffer 32 which converts the incoming signal to the appropriate voltage levels for interface. Buffer 32 is coupled to a pair of UARTs (Universal Asynchronous Receiver/-Transmitter) 33, one used for input and the other for output. UARTs 33 are then coupled to a bus 34. Bus 34 is coupled to a ROM 35 which is used to store the look-up tables and the conversion rules, see FIG. 2. A RAM 36 is also coupled to bus 34. RAM 36 operates as the intermediate storage for parameters as they are being smoothed or having other functions performed on them or other parameters. A microprocessor 37, such as the MC6802 manufactured by Motorola, Inc., is coupled to bus 34 to control the operations of device 30. The final LPC-10 signal is output through UARTs 33 and buffers 32 to an output node 38. The LPC-10 signal is then transmitted to a receiver as demonstrated in FIG. 1. In addition to the above, various switches 39 or stand alone controls 40 may be added to bus 34 through parallel ports 41. These switches and controls may be used to set device 30 to operate at different speeds (e.g. 2400 or 4800 BPS) or to operate on differing character sets, as described above, among other things.

Taking the procedure above for converting the word HELP and applying it to FIG. 3 the ASCII code /H/E/L/P/ is transmitted from a computer network to node 31 where it enters the conversion process through buffers 32 and UARTs 33. The ASCII code is then stored in RAM 36. Microprocessor 37 then takes the word from RAM 36 and checks it for exceptions stored in a portion of ROM 35. Since no exception exists the word is again stored in RAM 36 and just the /H/ is selected by microprocessor 37. This is then transmitted to ROM 35 where the phoneme is determined. The phoneme is then stored in RAM 36. Once this has been completed for all of the letters the phonemes are checked for allophones by taking them from RAM 36 and operating on them, using the rules of speech discussed above that are stored in ROM 35. Once the correct phonemes, or allophones, have been determined the LPC-10 parameters for each are selected from those stored in ROM 35. A more detailed description of LPC-10 parameters is provided in U.S. Pat. No. 4,392,018 entitled "Speech Synthesizer with Smooth Linear Interpolation" issued to the same inventor as the present application. These LPC-10 parameters are then stored in RAM 36. Microprocessor 37 then takes the phonemes from RAM 36 and performs the smoothing techniques on them. These smoothed parameters may then be stored in RAM 36 while the smoothing of other parameters is completed. Next, the smoothed parameters are selected from RAM 36 and quantized in microprocessor 37. The quantized parameters are then serialized by microprocessor 37 and transmitted to output port 38 through UARTs 33 and buffers 32. It should be noted that the above description is intended solely as an example and that the operating steps may not be in this particular order and that other intermediate steps may be included that are not reviewed here.

Thus, it is apparant that there has been provided, in accordance with the invention, a device and method that fully satisfies the object, aims and advantages set forth above.

It has been shown that the present invention provides an apparatus and method of linking computer networks, such as ASCII, to voice networks, such as LPC-10, utilizing the concepts of text to phoneme conversion; and phoneme to LPC conversion.

While the invention has been described in conjunction with specific embodiments thereof, it is evident that many alterations, modifications and variations will be apparant to those skilled in the art in light of the forgoing description. Accordingly, it is intended to embrace in the appended claims all such alternatives, modifications, and variations as are contained in the spirit and scope of the invention.

I claim:

1. A method of converting a text signal supplied by a computer network into Linear Predictive Coding (LPC) data which is transmittable over a voice network, said method comprising the steps of:

receiving the text signal at an LPC bridge device including a microprocessor and read-only memory (ROM);

checking through operation of the microprocessor, if the text signal represents an exception to a set of rules which define relationships between textual spellings and corresponding phonetic representations of the text signal;

first alternately utilizing the microprocessor to look up in the ROM an alternative phonetic signal for phonetic conversion, said first alternately utilizing step occurring in response to an indication of an exception by said checking step;

second alternately utilizing the microprocessor to look up in the ROM an alternative text spelling signal, said second alternately utilizing step being performed in response to an indication of an exception of said checking step and performed conditionally if said step of first alternately utilizing has not occurred;

third alternately utilizing the microprocessor to look up in the ROM an alternate set of rules for determining phonemes (as in a different language);

converting, through operation of the microprocessor, the text signal or alternate text spelling signal into a phonetic signal composed of a set of phonemes, said converting the text signal or alternate text spelling signal occurring in accordance with the set of rules or said alternate set of rules, the step of converting the text signal into a phonetic signal being performed in response to said steps of checking or second alternately utilizing the microprocessor to look up in the ROM;

converting, through operation of the microprocessor, the phonetic signal or the alternate phonetic signal into an allophonetic signal composed of a set of allophones; and converting, through operation of the microprocessor, the allophoneitc signal into LPC parameters.

2. A method as claimed in claim 1 additionally comprising the steps of:

smoothing, through operation of the microprocessor, the temporal transitions between the LPC parameters of said converting the allophonetic signal step to produce smooth LPC parameters;

quantizing, through operation of the microprocessor, the smoothed LPC parameters to produce quantized LPC parameters; and serializing, through operation of the microprocessor, the quantized LPC parameters.

3. A method as claimed in claim 1 additionally comprising the step of determining, through operation of the microprocessor, the punctuation effect of the text signal on the phonetic signal.

* * * * *